US005134743A

United States Patent [19]

Hukuba

[11] Patent Number: 5,134,743

[45] Date of Patent: Aug. 4, 1992

[54] TOOTHBRUSH FOR CONTROLLING BRUSHING-STROKE

[76] Inventor: Hiroshi Hukuba, Nazukari, Nagareyama, No. 914-1, Chiba, Japan

[21] Appl. No.: 703,825

[22] Filed: May 21, 1991

Related U.S. Application Data

[63] Continuation of Ser. No. 229,338, Aug. 5, 1988, abandoned.

[30] Foreign Application Priority Data

| | | | |
|---|---|---|---|
| Aug. 11, 1987 | [JP] | Japan | 62-200355 |
| Dec. 28, 1987 | [JP] | Japan | 62-334145 |
| Feb. 25, 1988 | [JP] | Japan | 63-42884 |
| May 9, 1988 | [JP] | Japan | 63-112251 |

[51] Int. Cl.[5] ..... A46B 9/04

[52] U.S. Cl. ..... 15/105; 15/167.1; 15/143.1; 434/263

[58] Field of Search ..... 15/105, 143 R, 159 R, 15/167.1, 167.2, 176.1, 246; 434/263; 128/62 A

[56] References Cited

U.S. PATENT DOCUMENTS

| | | | |
|---|---|---|---|
| 2,028,042 | 1/1936 | Braunstein . | |
| 2,877,477 | 3/1959 | Levin | 15/105 |
| 2,947,013 | 8/1960 | Silverman | 15/105 |
| 4,253,212 | 3/1981 | Fujita | 15/167.1 |
| 4,476,604 | 10/1984 | White | 15/105 |
| 4,680,825 | 7/1987 | White | 15/105 |

FOREIGN PATENT DOCUMENTS

| | | | |
|---|---|---|---|
| 909688 | 4/1954 | Fed. Rep. of Germany . | |
| 49-44477 | 4/1974 | Japan . | |
| 54-123065 | 8/1979 | Japan . | |
| 55-5061 | 2/1980 | Japan . | |
| 58-16664 | 4/1983 | Japan . | |
| 216355 | 5/1924 | United Kingdom | 15/176.1 |

*Primary Examiner*—Harvey C. Hornsby
*Assistant Examiner*—Mark Spisich
*Attorney, Agent, or Firm*—Flynn, Thiel, Boutell & Tanis

[57] ABSTRACT

A toothbrush for controlling brushing-stroke comprises a brush portion studded with bristles; a handle portion extended from the brush portion; a cavity associated with the handle portion for defining a space; and a moving member placed within the space for reciprocally moving within the space by reciprocal movement of the toothbrush and for hitting an end of the space and making a continuous hitting sound when the brushing-stroke of the reciprocal movement of the toothbrush is longer than a predetermined value. The use of the present toothbrush will reduce the brushing stroke until the continuous hitting warning sound ceases to perform the so-called "Bass' method " or "scrubbing method".

31 Claims, 10 Drawing Sheets

TOOTHBRUSH FOR CONTROLLING BRUSHING-STROKE

This is a continuation of Ser. No. 07/229,338, filed Aug. 5, 1988, abandoned.

BACKGROUND OF THE INVENTION:

1. Field of the Invention

The present invention relates to a toothbrush, and more particularly to a toothbrush for controlling back-and-forth reciprocating distance of toothbrushing, i.e., brushing stroke, at the time when one brushes one's teeth.

2. Description of the Related Art

In recent years, it has come to be understood that plaque and food particles cannot be completely removed from the teeth by the so-called "rolling method" wherein the toothbrush is rotated in terms of toothbrushing methods. At present, it is understood that the brushing with short back-and-forth strokes called as "Bass' method" or "scrubbing method" in which the toothbrush is moved back and forth with a distance of several millimeters (hereinafter referred to as the short stroke brushing) is most appropriate in terms of plaque control.

However, the actual situation is such that most people perform the "horizontal method" or the brushing with long back-and-forth strokes with a long distance of about 15–50 mm (hereinafter referred to as the long stroke brushing). Although the long stroke brushing gives an impression that it is apparently effectual and brushes well, the bristles come into contact with only the projecting surfaces of teeth and do not reach those boundary areas between the teeth and the gums, recessed portions between the teeth or fine grooves on the clenching surfaces of the teeth that require brushing. Accordingly, there are problems that, over a long period of years, the so-called wedge-shaped loss results in which projecting surfaces of the teeth and the gums become worn, and that periodontosis and decayed teeth also result due to the incomplete cleaning at the aforementioned boundary areas and the like.

Accordingly, it is necessary to carry out the above-described short stroke brushing. Nevertheless, it is extremely difficult for ordinary people to master the procedure of the short stroke brushing. The actual situation is such that, if one who has mastered it neglects to exercise caution, the brushing strokes become large before he is aware of it, resulting in the long stroke brushing.

Conventionally, there has been proposed a toothbrush device designed to correct a method of brushing teeth, as disclosed in Japanese Utility Model Publication No. 16664/1983 . (which corresponds to Fujita U.S. Pat. No. 4,253,212). However, this device has been proposed strictly for the purpose of leading a person to brush his teeth with a low back-and-forth speed of the toothbrush, and it is not designed to effect the short stroke brushing described above. With this conventional toothbrush device, however, it may be impossible for one to master the appropriate short stroke brushing.

SUMMARY OF THE INVENTION

Accordingly, an object of the present invention is to provide a toothbrush for controlling brushing-stroke which makes it easy to carry out the proper short stroke brushing by providing a warning at the time when the long stroke brushing is performed, thereby ensuring that people will be experienced with the short stroke brushing without skill.

To this end, according to the present invention, there is provided a toothbrush for controlling brushing-stroke, comprising: a brush portion studded with bristles; a handle portion extending from the brush portion; space means associated with the handle portion for defining a space; and movable means placed within the space for reciprocally moving within the space by reciprocal movement of the toothbrush and for hitting an end of the space when the brushing-stroke of the reciprocal movement of the toothbrush is longer than a predetermined value.

By virtue of this arrangement, if the brushing-stroke or reciprocating distance of the toothbrush is large, the movable means or moving member in the movement space or chamber tends to move relatively by exceeding the movable range of the movement chamber owing to the inertia. Consequently, the moving member hits the end of the movement chamber and generates a continuous rattling sound, thereby giving a warning that the person is performing the long stroke brushing. If the reciprocating distance is reduced, the amount of movement of the moving member becomes small, and the moving member is either hits less frequently the wall of the movement chamber or ceases to hit it at all, thereby letting the user know that he is performing the proper short stroke brushing. Hence, it becomes possible to allow the user to carry out the short stroke brushing without requiring any experienced skills.

In a preferred embodiment, the warning sound is generated when the brushing-stroke of the reciprocal movement of the toothbrush is longer than $15 \pm 3$ mm while the brushing speed of the reciprocal movement is between 120 to 320 cycles/min.

In another preferred embodiment, the coefficient of friction between an inner surface of the space and the moving member is 0.466 or less.

The coefficient of rebound of the moving member from the end of the space is preferably 0.65 or less.

The movable length of the moving member within the space is preferably 32 mm or less.

The sound pressure level of the hitting sound of the moving member against the end of the space is preferably 60 dB or more.

According to a detailed embodiment of the present invention, a hitting portion constituting at least one end of the movement chamber is formed separately from the toothbrush body. Consequently, the moving member is prevented from rebounding more than is necessary, thereby ensuring that a warning sound will not be issued when one is performing the proper short stroke brushing.

According to another detailed embodiment of the present invention, at least one end of the movement chamber is formed separately from the toothbrush body and is installed on the toothbrush body with a predetermined pressure. Consequently, the sound pressure level of a warning sound to be issued when one performs the long stroke brushing is increased to ensure that the warning sound can be easily heard even when a masking phenomenon takes place due to a sound of sliding between bristles and teeth.

DETAILED DESCRIPTION OF THE PREFERRED EMBODIMENTS

Referring now to the accompanying drawings, a description will be given of embodiments of the present invention.

Figure 1:
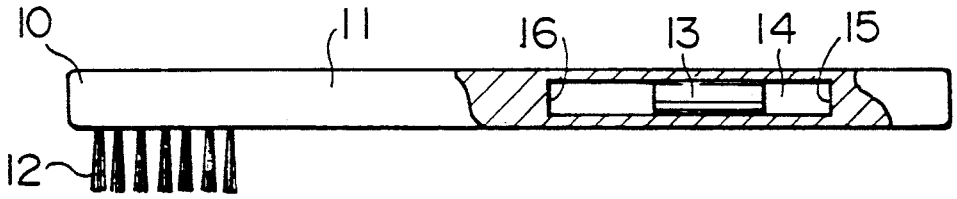
FIG. 1 is a partly cutaway side elevational view illustrating a first embodiment of a toothbrush for controlling brushing-stroke in accordance with the present invention.

FIG. 1 illustrates a first embodiment of the present invention. This toothbrush mainly comprises a brush portion 10 and a handle portion 11 extending from the brush portion 10, the brush portion being studded with bristles 12.

A movement chamber 14 of a cylindrical shape is formed in the handle portion 11, and a moving member 13 is disposed within this movement chamber 14. The moving member 13 is cylindrically shaped in this embodiment, while the movement chamber 14 has a rectangular cross section. However, the configurations thereof are not restricted to the same. Reference numerals 15, 16 respectively denote end walls of the movement chamber 14.

If the handle portion 11 is held by the hand and the long stroke brushing in which the stroke, i.e., the reciprocating distance, is large, the moving member 13 in the movement chamber 14 hits the opposite end walls 15, 16, and continuous rattling sounds thus generated inform the user of the stroke being too large. If the short stroke brushing is carried out, the amount of movement of the moving member 13 becomes small, and the moving member 13 hits either of the opposite end walls 15, 16, or ceases to hit the opposite end walls, thereby informing the user that he or she is performing the short stroke brushing properly.

Figure 2:
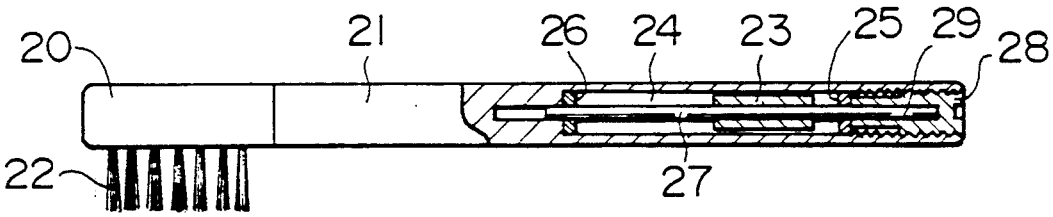
FIG. 2 is a partly cutaway side elevational view illustrating a second embodiment thereof.

FIG. 2 illustrates a second embodiment of the present invention. In this second embodiment, a brush portion 20 having bristles 22 is arranged to be separable from a handle portion 21, and this arrangement makes it possible to replace only the brush portion 20 to improve the economic efficiency. In addition, a left-hand side end wall 26 of a movement chamber 24 of the handle portion 21 may be formed of a material of low hardness, while a right-hand side end wall 25 thereof is formed of a material of high hardness. Furthermore, the right-hand side wall 25 is made movable in the axial direction by means of an adjusting screw 28, thereby making it possible to adjust the length of the movement chamber 24, i.e., the movable distance of a moving member 23. The adjusting screw 28 is screwed into an internal screw 29 formed at an outer end of the handle portion 21, and as the adjusting screw 28 is tightened or loosened, the right-hand end wall 25 which abuts against the adjusting screw 28 is adapted to move in the axial direction. In addition, the moving member 23 is fitted around a support shaft 27 with a clearance and is made movable along the support shaft 27. One end of this support shaft 27 is secured to the adjusting screw 28, while the other end thereof is slidably inserted into the handle portion 21 by passing through the left-hand end wall 26.

According to this embodiment, the magnitude, pitch, and tone of the rattling sound generated when the moving member 23 strikes against the end walls differs due to the difference in hardness of the left- and right-hand end walls 25, 26, with the result that the determination of the magnitude of the stroke can be further facilitated. Incidentally, it goes without saying that opposite end surfaces of the moving member 23 may be provided with different hardness by using different materials for the opposite end surfaces so that the magnitude, pitch, and tone of the rattling sound when it hits the opposite end walls will vary.

Furthermore, in this embodiment, it is possible to adjust the movable range of the moving member 23 in correspondence with the degree of proficiency in the short stroke brushing of the person who brushes his or her teeth, thereby making it possible to effect a more effecting cleaning operation of teeth.

Figure 3:
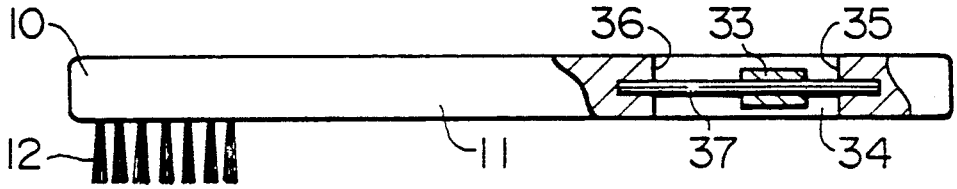
FIG. 3 is a partly cutaway side elevational view illustrating a third embodiment thereof.

FIG. 3 illustrates a third embodiment of the present invention. This embodiment differs from the first embodiment in that opposite side surfaces of a movement chamber 34 are made open, a moving member 33 is fitted around a support shaft 37 in such a manner as to be movable in the axial direction, the opposite ends of the support shaft 37 are passed through opposite end walls 35, 36 of the movement chamber 34, and the supporting shaft 37 is fixed to the handle portion 11.

According to this embodiment, since the movement chamber 34 is made open, the rattling sound of the moving member 33 against the left- and right-hand end walls 35, 36 can be heard directly.

Figure 4:
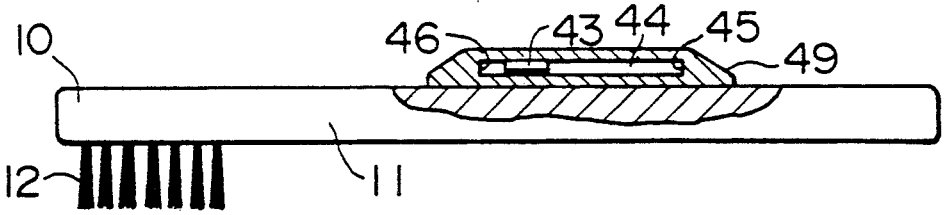
FIG. 4 is a partly cutaway side elevational view illustrating a fourth embodiment thereof.

FIG. 4 illustrates a fourth embodiment of the present invention. This embodiment differs from the first embodiment in that a case 49 constituting a movement chamber 44 is formed separably from the handle portion 11, and this case 49 is secured to the handle portion 11 by means of an adhesive or the like. Reference numeral 43 denotes a moving member, and numerals 45, 46 denote opposite end walls.

According to this embodiment, since the movement chamber 44 enclosing the moving member 43 is formed separably from a toothbrush body, an ordinary commercially available toothbrush can be used as the toothbrush in accordance with the present invention by simply fitting the movement chamber 44 onto the toothbrush body.

It should be noted that, the case 49 may be attached to the handle portion 11 by means of a rubber pipe or other detachably coupling means so as to make the case 49 detachable with respect to the handle portion 11, and an upper surface, lower surface, rear-end surface, or the like may be selected arbitrarily as the position of attachment thereof.

Figure 5:
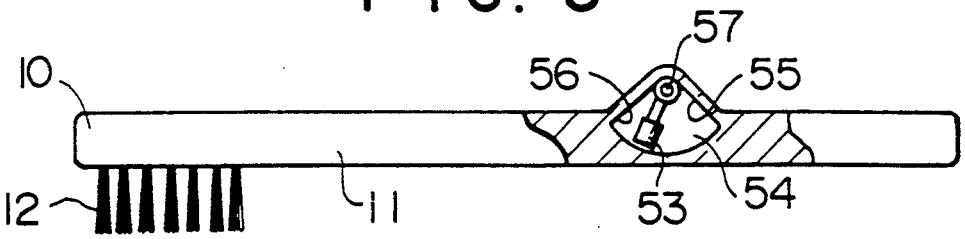
FIG. 5 is a partly cutaway side elevational view illustrating a fifth embodiment thereof.

FIG. 5 illustrates a fifth embodiment of the present invention. This embodiment differs from the first embodiment in that a moving member 53 is formed into the shape of a pendulum which oscillates with a support shaft 57 as a center, a movement chamber 54 is correspondingly formed to have a substantially fan-shaped cross section, and end walls 55, 56 are arranged in the direction of the oscillating radius of the moving member 53.

Figure 6:
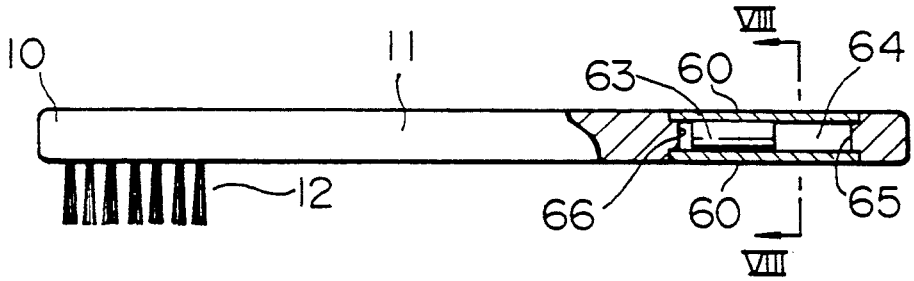
FIG. 6 is a partly cutaway side elevational view illustrating a sixth embodiment thereof.
Figure 7:
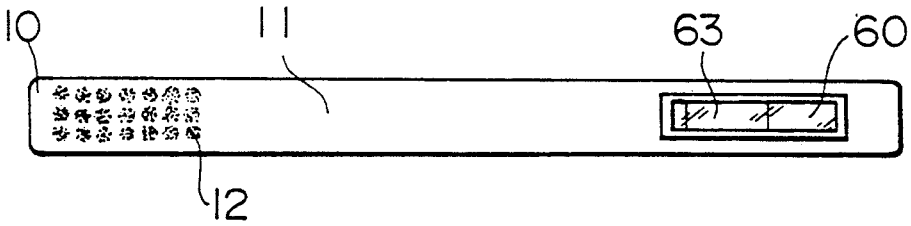
FIG. 7 is a front elevational view of the sixth embodiment.
Figure 8:
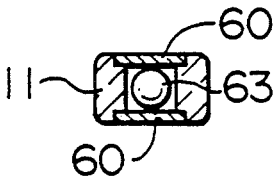
FIG. 8 is a cross-sectional view taken along the line VIII—VIII of FIG. 6.

FIGS. 6 to 8 illustrate a sixth embodiment of the present invention. This embodiment differs from the first embodiment in that the moving member 63 is arranged to be seen from the outside. In other words, the opposite side walls of a movement chamber 64 are constituted by transparent covers 60, and the movement of the moving member 63 can be viewed through the transparent covers 60 by making use of a mirror or the like while the teeth are being brushed. Accordingly, it becomes easier to acquire the procedure of the short stroke brushing. Reference numerals 65, 66 denote opposite end walls of the movement chamber 64. Incidentally, it goes without saying that the moving member can be viewed from the outside if the overall handle portion is formed of a transparent material.

Figure 9:
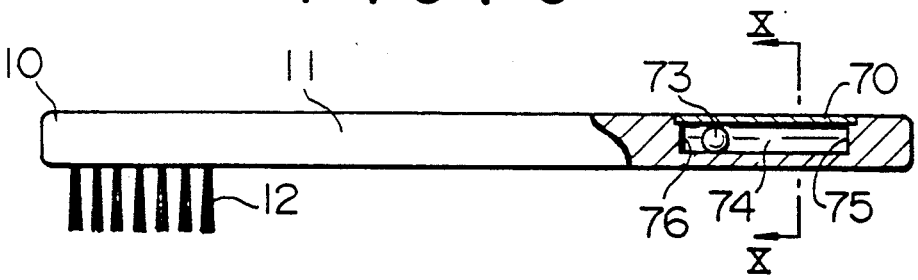
FIG. 9 is a partly cutaway side elevational view illustrating a seventh embodiment of the toothbrush.
Figure 10:
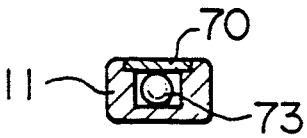
FIG. 10 is a cross-sectional view taken along the line X—X of FIG. 9.

FIGS. 9 and 10 illustrate a seventh embodiment of the present invention. This embodiment differs from the first embodiment in that a moving member 73 is formed into a spherical shape, and only one side surface of a movement chamber 74 is formed by a transparent cover 70. Reference numerals 75, 76 denote opposite end walls of the movement chamber 74. The transparent cover 70 may be formed to have a curvature so that the movement of the moving member 73 can be viewed in an enlarged manner.

In this embodiment as well, the moving member 73 produces a rattling sound when it hits the opposite end walls 75, 76 and is thus capable of issuing a warning against the long stroke brushing. In addition, in the same way as the sixth embodiment, the moving member 73 can be viewed, thereby allowing the user to easily set the brushing stroke suitable for the short stroke brushing by viewing the moving member 73.

Although not shown in the drawings, the movement chamber may alternatively be comprised of a bottomed bore extending from the end of the toothbrush body in its axial direction and a lid fitted to an opening end of the bore.

Figure 11:
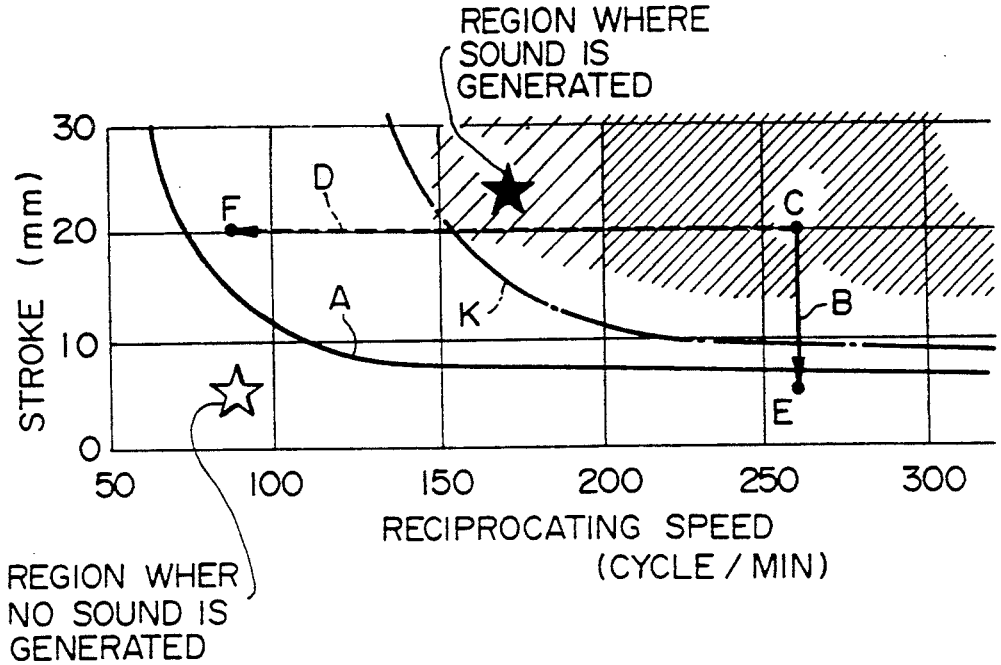
FIG. 11 is a graph in an ideal state, illustrating the relationship between the reciprocating speed of a handle portion and the stroke in an experiment conducted by the present inventor.

FIG. 11 is a graph of experimental results conducted by the inventor. In this graph, the ordinates represent the reciprocating distance, i.e., the stroke (mm), of the back-and-forth movement of the toothbrush, while the abscissas represent the reciprocating speed (cycles/-min.) of the toothbrush.

Curve K shows a case where the toothbrush in accordance with the first embodiment was used. Specifically, curve K shows a curve of a boundary region where the continuous rattling sound was generated in a case in which a substantially cylindrically shaped piece made of stainless steel and having a diameter of 4 mm and a length of 10 mm was used as the moving member, the length of the movement chamber was set to 25 mm, and the sectional dimension thereof was set to a 4.2 mm square. Meanwhile, curve A shows a case in which a 4 mm-ball was used as the moving member, the length of the movement chamber was set to 17 mm, and the sectional area was set to a 4.2 mm square. The region above curve A or K is one where the moving member hits the opposite end walls of the movement chamber and the continuous rattling sound is thereby generated. In particular, the shadowed portion in the region above curve K indicates the zone of the long stroke brushing which is carried out by a large majority of people. In this shadowed portion, the highly dense portion indicates the zone which is most frequently used by people during the long stroke brushing. On the other hand, a region below curve A or K and close to those curves is one in which the moving member does not hit the end walls of the movement chamber or strikes against only one end wall, producing small irregular sound. The region considerably below curve A or K denotes a noiseless region where the moving member produces no rattling sound. The region below the curves is that for the short stroke brushing which is necessary for plaque control.

If a person who brushes his teeth with a brushing stroke of 20 mm and the reciprocating speed of 260 cycles/min., as shown at point C, uses a toothbrush which is operated with curve K, he would hear large continuous rattling sound as the moving member strikes against the opposite end walls of the movement chamber. If he reduces the motion of the hand in such a manner as to reduce the stroke in order to eliminate this rattling sound and repeats this training, the position of point C moves gradually downward, and exceeds curve K if the stroke becomes 10 mm or below. In the region below curve K and adjacent thereto, a small discontinuous rattling sound in which the moving member still hits one surface may still be produced. If the training is further continued and the position in question reaches that of a lower point E from curve K, i.e., the position where the stroke is about 5 mm and the speed is 260 cycles/min., substantially no rattling sound is heard. Hence, it can be confirmed that the teeth are being brushed properly.

In this connection, an examination will be given of a case where the toothbrush disclosed in Japanese Utility Model Publication No. 16664/1983 (which corresponds to Funita U.S. Pat. No. 4,253,212) is used as a comparative example, with reference to FIG. 11. This conventional device has its purpose to reduce the reciprocating speed of the toothbrush. However, a person who uses this device learns to brush the teeth in the vicinity of point F by reducing the speed alone while maintaining the stroke of 20 mm along the dotted line D from the position of point C. Thus, it will be appreciated that, in the case of this conventional art, its object and advantages are totally different from those of the present invention, although its device is similar to the present invention in that both devices enable one to experience the state of brushing in the noiseless region.

As is apparent from FIG. 11, if one uses the toothbrush embodying the present invention indicated by curve K by using as a starting point the brushing state indicated by the high-density shadowed portion in which a large majority of people are brushing teeth at a high frequency, i.e., in which the speed is 200 to 320 cycles/min. and the stroke is 15 to 50 mm, then one can learn to brush teeth at the speed of 200 to 320 cycles/min. and the stroke of 10 mm or less, i.e., in the region below curve K. If the toothbrush indicated by curve A is used, one is able to learn brushing of teeth at a stroke smaller than in the case of curve K and to continue the same, allowing him to carry out ideal, proper brushing more efficiently.

In the above, a description has been given of a case where the targeted stroke of "several millimeters", which is considered in the dentistry authorities to be an ideal value in the short stroke brushing, is performed. A description will be given hereafter on the basis of the difference between the reality and the aforementioned ideal.

First, the actual situation of brushing of teeth will be described in detail with reference to FIG. 12. In this figure, the abscissas represent the reciprocating speed (cycles/min.) of the toothbrush in the same way as FIG. 11. In this reciprocating speed, 120 to 150 can be defined as "very slow"; 150 to 200 as "slow"; 200 to 260 as "normal"; and 260 to 320 as "fast". The ordinary speed is in the range of 200 to 320 cycles/min. It is very rare that brushing is carried out at the speed of 120 to 200 cycles/min.

Figure 12:
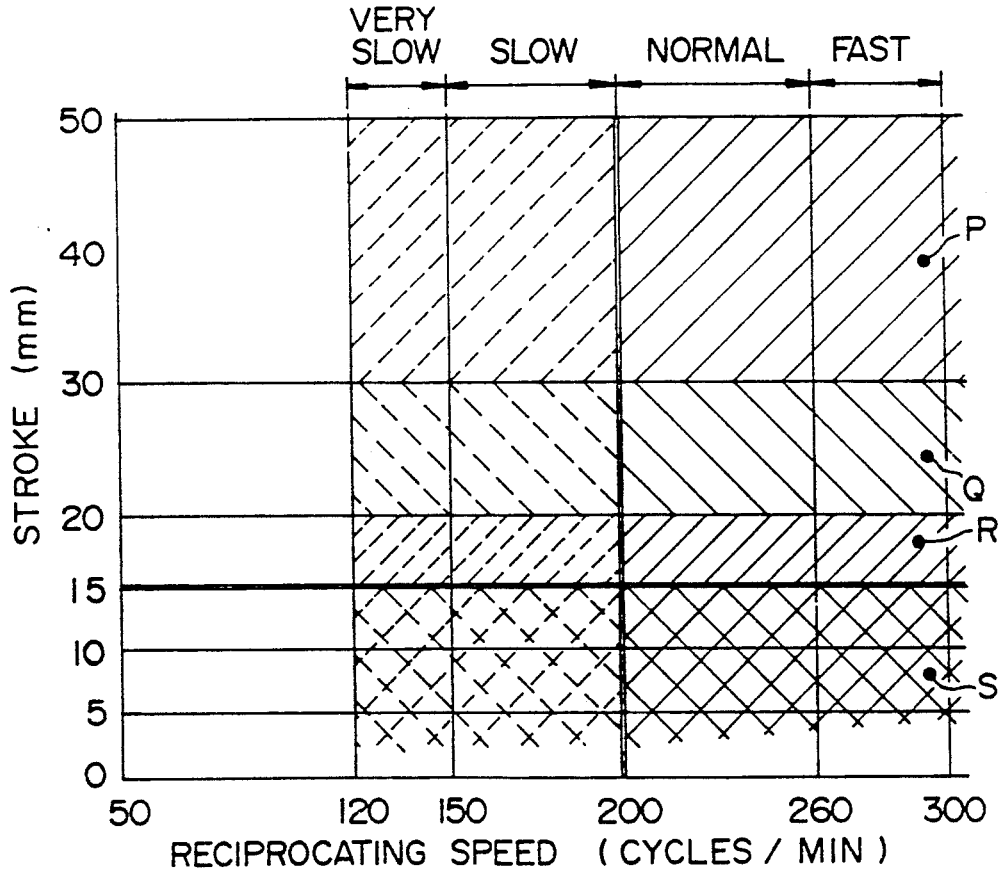
FIG. 12 is an evaluatory chart in which the stroke is evaluated for each region in accordance with the values thereof.

The ordinates in FIG. 12 represent the reciprocating distance of the toothbrush, i.e., stroke (mm). With regard to the stroke, the region of 30 to 50 mm indicated by reference character P denotes the region of "the so-called horizontal brushing or the long stroke brushing in which the teeth are brushed firmly without any caution". The region of 20 to 30 mm indicated by reference character Q is that where "one is brushing carefully by thinking that the short stroke brushing is necessary". The region of 15 to 20 mm indicated by reference character R is that where "one presumes that he is performing the short stroke brushing at the stroke of 5 mm". The region indicated by reference character S is that of "the proper short stroke brushing attained by the toothbrush in accordance with the present invention". It should be noted that, in contrast to "several millimeters" which is the aforementioned ideal targeted stroke, in FIG. 12, region S is set to 15 mm or less. The reson for settling the stroke to this valve is that since there is too large a gap between the actual situation and the ideal target set by the dentistry authorities, the stroke was set to 15 mm or less as the attainable target which is in tune with the actual situation.

Consideration will now be given to a coefficient of friction $\mu$ between the moving member and the movement chamber, a coefficient of rebound e of the moving member with respect to an end wall of the movement chamber, and a movable distance l of the moving member within the movement chamber.

Figure 13:
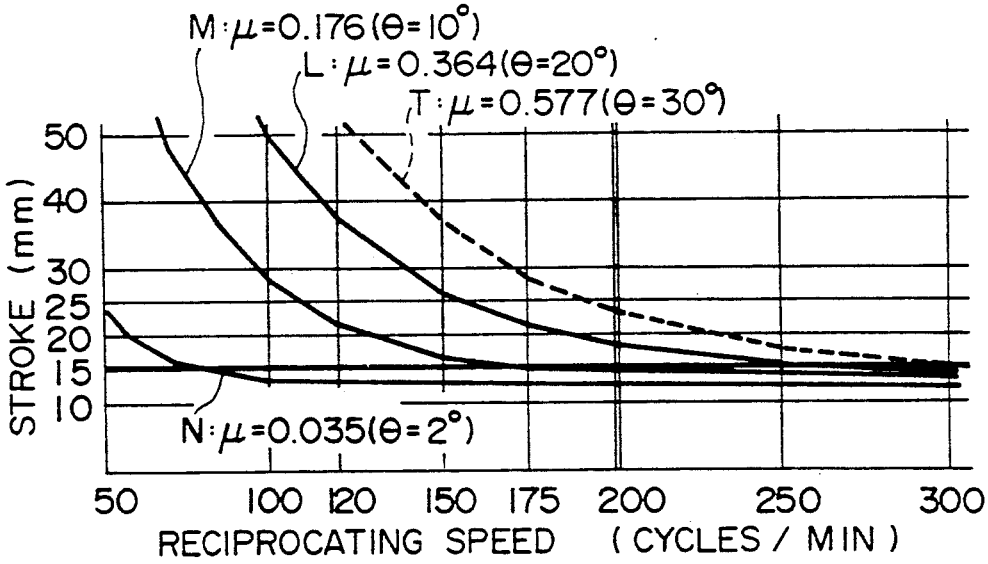
FIG. 13 is a graph illustrating characteristic curves when the coefficient of friction is changed.
Figure 14:
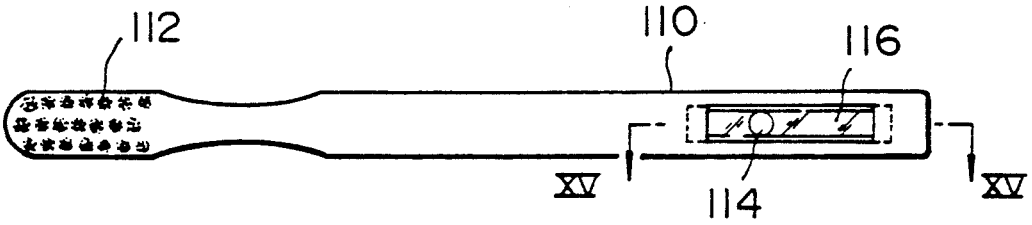
FIG. 14 is a front elevational view of an eighth embodiment of the toothbrush for controlling the brushing stroke.
Figure 15:
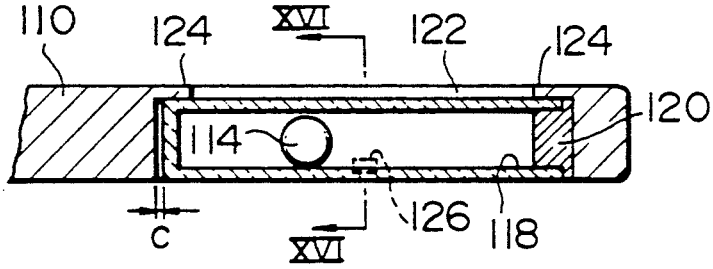
FIG. 15 is a cross-sectinal view taken along the line XV—XV of FIG. 14.
Figure 16:
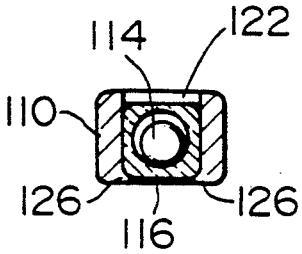
FIG. 16 is a cross-sectional view taken along the line XVI—XVI of FIG. 15.
Figure 17:
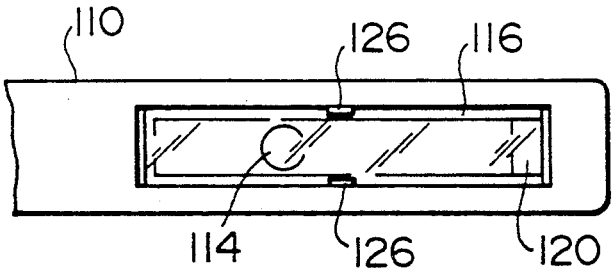
FIG. 17 is a bottom view of an essential portion shown in FIG. 14.

FIG. 13 is a graph illustrating curves of a boundary in the region where the continuous rattling sound is generated, while the coefficient of friction is changed in various ways. The abscissas and ordinates thereof denote the same as those of FIG. 11. Characteristic curves T, L, M and N show the relationships between the stroke and the speed when the coefficient of friction $\mu$ is 0.577, 0.364, 0.176 and 0.035, respectively, and the movable distance l is 22 mm. The regions above the respective curves represent regions where the continuous rattling sound is generated due to the hitting of the end walls of the movement chamber, while the regions therebelow represent the regions where irregular one wall hitting sound or no sound is generated. $\theta$ represents an angle of friction corresponding to each of the coefficients of friction. It can be understood that the smaller the coefficient of friction, i.e., the angle of friction, the closer to horizontality the characteristic curve becomes, and that as the angle of friction becomes large, the characteristic curve rises sharply upward in the low-speed region of the reciprocating movement. Considering the fact that an attempt may be made to decrease the stroke below a specific value while the reciprocating speed of brushing, which is practiced by people in general, is being maintained, it should be noted that the characteristic curve is preferably close to horizontality at the speed of 200 to 320 cycles/min. practiced by people in general. Otherwise, no or less rattling sound could be obtained by decreasing the brushing speed without decreasing the brushing stroke, thus misleading the user. It can be said that curves L, M and N in FIG. 13 attain this requirement.

On the other hand, the prior art device disclosed in Japanese Utility Model Publication No. 16664/1983, (which correspond to Funita U.S. Pat. No. 4,253,212) as discussed before should have the characteristic curve which is substantially vertical at least at the lower speed region generally practiced so as to decrese the speed, which in turn necessitates the coefficient of friction to be large. It is described in this Publication that a resisting member is provided in the movement chamber to provide resistance to the moving piece, and such a provision proves the characteristic of this device.

Next, the difference in the stroke between 200 cycles/min. and 300 cycles/min. in the respective characteristic curves will be shown in Table 1.

It has already been mentioned that it is ideal that the difference in the stroke in this Table is less. As shown in Table 1, as the coefficient of friction $\mu$ changes, the difference in the stroke also changes, and it may be possible to determine the limit of the coefficient of friction by using this difference in the stroke as a criterion.

TABLE 1

| Curve | $\theta$ | $\mu$ | Difference in stroke between 200 cycles/min. and 300 cycles/min. (mm) |
|---|---|---|---|
| T | 30° | 0.577 | 8.5 |
| L | 20° | 0.364 | 4 |
| M | 10° | 0.176 | 2.5 |
| N | 2° | 0.035 | 0.1 |

Let us now assume that, using as a reference value the maximum value of the stroke, i.e., 15 mm, the respective curves are moved in parallel in the direction of ordinates by varying the movable distance l of the moving member in FIG. 13 so that the central point of the difference in the stroke in each of the curves is set to the 15 mm stroke. Accordingly, in the case of curve T, if 4 mm (which is approximately half the difference in the 8.5 mm stroke) is distributed to the targeted stroke of 15 mm, the maximum value at 200 cycles/min. becomes 19 mm, while the minimum value at 300 cycles/min. becomes 11 mm, which represents a deviation of 27% with respect to 15 mm. Since a deviation of 25% or more is generally considered to be unadvisable, it can be determined that this deviation is impractical. In the case of curve L, on the other hand, the maximum value becomes 17 mm, while the minimum value becomes 13 mm, which represents a deviation of 13% from the targeted value of 15 mm. Thus it can be determined that this is a practicable range.

Accordingly, in the present invention, it is assumed that curve T shown by the dotted line in FIG. 13 is not used, and the maximum limit of the angle of friction is set as $\theta=25°$, which is an intermediate value between the angle of friction of curve T when $\theta=30°$ and that of curve L when $\theta=20°$. Therefore, 0.466 of the coefficient of friction $\mu$ corresponding to this angle of friction is set as a maximum limit.

A description will now be given of the coefficient of rebound between the moving member and the opposite end walls of the movement chamber.

To calculate the numerical value of the coefficient of rebound, if it is assumed that, in a case where the moving member is dropped vertically inside a fixed movement chamber, the height prior to the drop is h, and the height of rebound after hitting against the end wall of the movement chamber after the drop is h', the coefficient of rebound can be determined for the following formula:

$$e = \sqrt{h'/h}$$

In the case of the present invention, this rebounding should ideally be nil, i.e., the coefficient of rebound e should ideally be zero, which is the case of completely non-elastic collision (plastic collision). In other words, the kinetic energy prior to collision should ideally be converted into such forms of energy as deformation during collision, vibration, sound, and heat during collision. In reality, however, it is desirable that the value of the coefficient of rebound e be small and that the amount of rebound be small.

If the coefficient of rebound e and the amount of rebound are large, even if the aforementioned coefficient of friction $\mu$ is 0.466 or less, there is the possibility that the behavior of the moving member may become inaccurate, making it impossible to attain the initial objective.

In other words, according to an experiment conducted by the present inventor, it became clear that, if the coefficient of rebound e is approximately 0.74, even when one is performing brushing in the aforementioned region S, there are cases where the stroke becomes instantly large, thereby resulting in brushing in the region of sound above the characteristic curve, or even if brushing is performed in the region below the curve, the moving member hits one surface, causing the moving member to rebound greatly due to the elastic collision and resulting in the repeated collision against the opposite walls. As a result, one is misled into believing that he is performing the undesirable long stroke brushing.

On the other hand, it was understood that, when the coefficient of rebound e is about 0.55 or below, such a problem does not occur.

For this reason, the upper limit of the coefficient of rebound e is set to 0.65 which is approximately an intermediate value between 0.55 and 0.74. Incidentally, this coefficient of rebound generally becomes large if the configuration of the moving member is spherical rather than cylindrical.

A description will now be given of the movable distance l of the moving member inside the movement chamber.

According to the experiment conducted by the inventor, when the movable distance $l=22$ mm, the coefficient of friction $\mu=0.035$ (angle of friction $\theta=2°$), and the moving member is a steel ball of a 6 mm diameter, the stroke to make the continuous rattling sound in the case of a reciprocating speed of 200 cycles/min. was approx. 15 mm. In other words, the stroke is approx. 7 mm shorter when the movable distance is 22 mm. According to another experiment, the stroke to make the continuous rattling sound in the case of the speed of 200 cycles/min. was approximately 9 to 11 mm where $l=23$ mm, $\mu\approx0.035$, and the moving member is a stainless steel ball of 4.8 mm diameter. This stroke of 9 to 11 mm is approximately 12 to 14 mm shorter than the movable distance l 23 mm.

Accordingly, the maximum stroke is set to 18 mm, which is an intermediate value between the maximum value of curve T, 19 mm, and the maximum value of curve L, 17 mm, and 32 mm obtained by adding the largest difference 14 mm to the same is set as the maximum limit of the movable distance l. Therefore, the practical value of the target brushing-stroke can be defined in such a manner that the maximum value is 18 mm as discussed above and the minimum value is 12 mm, which is an intermediate value between the minimum value of curve T (11 mm) and that of curve L (13 mm), and, as a result, can be determined to be 15±3 mm.

This value is a maximum value in practical use. In the future, when people's brushing technique improves as a result of the widespread use of the toothbrushes according to the present invention in the future, it is desirable to set the upper limit in region S shown in FIG. 12 to such a small value as 10 mm, 7 mm, or 5 mm shown in FIG. 11. In such a case, the movable distance l can be set to 24 mm, 21 mm, or 19 mm or thereabouts, respectively. In other words, in FIG. 13, the coordinates can be moved in parallel along the ordinates by varying the movable distance.

As described above, in accordance with the above-described embodiment, when the user performs brushing at the sped of 200 to 320 cycles min., which is the normal reciprocating speed, if, for instance, the stroke is greater than 15±3 mm, the moving member continuously hits the opposite walls of the movement chamber, producing a continuous rattling sound, and if the stroke is smaller than 15±3 mm, one-sided hitting or no hitting takes place. Hence, the user can perform the short stroke brushing with the stroke of, for instance, 15±3 mm or below.

It should be noted that the foregoing description is the case where the handle portion of the toothbrush is held horizontally, and the user will master the proper short stroke brushing with the handle portion held horizontally. Presumably, there are cases where brushing is performed with the handle portion held vertically, i.e., not in the horizontal position, such as when the rear sides of the teeth are to be brushed. In such a case, it is possible to apply the short stroke brushing mastered by the use of the toothbrush held in the horizontal position to the case where the handle portion is held vertically. It is thus possible to obtain an excellent effect of brushing in any cases.

It should also be noted that in case the handle portion of the toothbrush is held at an angle to horizontality, the stroke for causing the continuous rattling sound would become longer than that in the case of the horizontal holding.

A description will now be given of another aspect of the present invention.

FIGS. 14 to 17 illustrate an eighth embodiment of the present invention. In this embodiment, the distal end portion of a toothbrush body 110 is embedded with bristles 112, while the proximal end portion of the toothbrush body 110 is provided with a moving member case 116 accommodating a moving member 114. The moving member 114 is formed into a spherical shape and is movable at least in the longitudinal direction thereof within a movement chamber 118 formed by the moving member case 116. As particularly shown in FIG. 16, inner surfaces of the moving member case 116 are formed with a circular cross section which is slightly larger than the diameter of the moving member 114. Meanwhile, outer surfaces thereof are formed into a rectangular cross section whose four corners are chamfered. The moving member case 116 mainly comprises a bottomed cylindrical casing formed by a transparent material, such as acrylic resin, and a cover 120 which is fitted to an end portion of this casing and formed of, for instance, polyethylene or nylon.

A cavity 122 is formed at a proximal end portion of the toothbrush body 110 so as to fix the moving member case 116 which is formed separately from the toothbrush body 110. This cavity 122 is arranged in such a manner as to penetrate through the upper and lower surfaces, and a flange 124 serving as a stopper is provided integrally on either the upper or lower surface in a projecting manner. In addition, dimensions between inside walls in the cavity 122 are set to be substantially identical with the dimensions between outside walls of the moving member case 116. Meanwhile, the longitudinal length of the cavity 122 is formed to be slightly greater than the longitudinal length of the moving member case 116. Accordingly, a slight gap c remains between an end portion of the cavity 122 and an end portion of the moving member case 116 in the longitudinal direction thereof when the moving member case 116 is installed in the cavity 122. To prevent the moving member case 116 from coming off the cavity 122, a pair of claws 126 are formed integrally on the inlet-side of the cavity 122. At the time of fitting the moving member case 116, the moving member case 116 is inserted by pushing away the claws 126 by subjecting the same to elastic deformation. In the state in which the moving member case is inserted completely, the claws 126 are arranged to support the moving member case 116 from the rear with a snap action.

If the moving member is made spherical as in the case of this embodiment, the coefficient of rebound e as discussed before tends to become large, and the behavior of the moving member becomes inaccurate. Therefore, it is conceivable to form the moving member into a cylindrical shape and to allow this cylindrical moving member to move while sliding with respect to the movement chamber. In this case, however, there is a possibility that the moving member may be attracted by the end wall of the moving member case due to static electricity, thereby making the coefficient of friction larger than an inherent value, thus larger than the aforementioned value of 0.466. In addition, when the moving member is made to move while sliding, the coefficient of friction between the moving member and the sliding surface may become large depending on the precision of the sliding surfaces. If this coefficient of friction becomes large, there is a possibility that it becomes impossible to attain the object of the present invention, i.e., causing the moving member to constantly hit the opposite walls of the movement chamber when the reciprocating distance in brushing, i.e., the stroke, is above a certain level (for example, above 15 ±3 mm).

According to this embodiment, by forming the moving member into a substantially spherical shape to allow the moving member to roll within the movement chamber, an attempt is made to reduce the coefficient of friction, and the attraction of the moving member on the walls of the moving member case due to static electricity is prevented from becoming large, so as to keep the coefficient of friction 0.466 or less. At the same time, it is possible to reduce the coefficient of rebound e if either a hitting portion constituting at least one end of the movement chamber or the moving member case itself is formed separately from the toothbrush body. This reduction in the coefficient of rebound e can be made further positive by installing the hitting portion or the moving member case in the toothbrush body in a non-fixed state.

Figure 18:
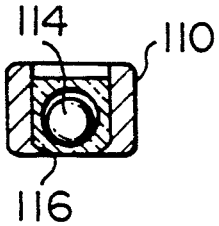
FIG. 18 is a cross-sectional view of a modification of the eighth embodiment taken at the same position as that of FIG. 16.
Figure 20:
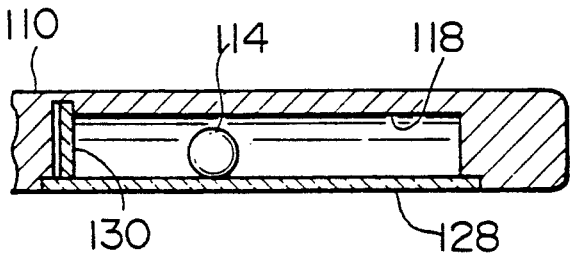
FIG. 20 is an enlarged cross-sectional view of an essential portion illustrating still another modification of the eighth embodiment.
Figure 21:
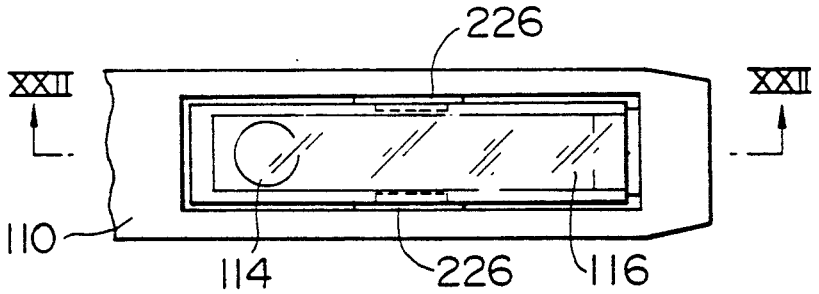
FIG. 21 is an enlarged top plan view of an essential portion of a ninth embodiment of the toothbrush for controlling brushing-stroke in accordance with the present invention.
Figure 22:
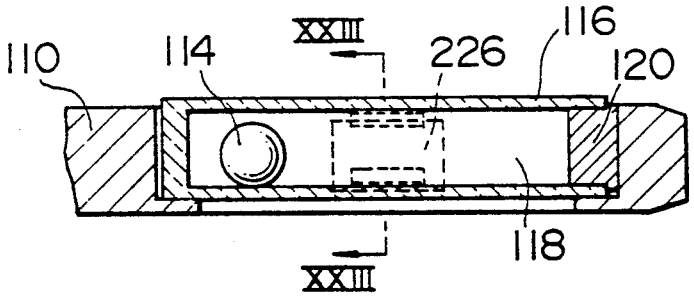
FIG. 22 is a cross-sectional view taken along the line XXII—XXII of FIG. 21.

This non-fixed state includes the following states: the state in which the clearance c is left between the moving member case 116 and the cavity 122, and, with respect to the external surfaces of the moving member case 116, the moving member case 116 is retained by a predetermined retaining force; the state in which the aforementioned clearance c is not provided; the state in which the four corner portions of the moving member case 116 are not chamfered, and the moving member case can be fitted into the cavity 122 of the .toothbrush body 110 without any clearance as shown in FIG. 18; or the moving member case 116 may be fitted in the cavity 122 with a certain degree of play. Moreover, the non-fixed state may also include the state where the moving member case is fixed by glue or other appropriate manner only at a limited partial range of its side walls to the cavity wall and the remaining portion of the moving member case is retained free. Yet in this state, the limited partial range of the side walls may be formed integral to the cavity wall. Furthermore, as shown in FIG. 20, a movement chamber 118 may be formed by boring the toothbrush body 110, and an end wall body 130 which is separate from the toothbrush body 110 may be provided to define at least one end wall of the movement chamber in such a manner as to be capable of moving by a microscopically small amount. Incidentally, reference numeral 128 in FIG. 20 denotes a transparent cover.

In other words, it suffices if at least one end wall of the movement chamber 118 is formed separately from the toothbrush body, and retains at least microscopical movement. Consequently, the hitting energy of the moving member is absorbed by a small amount of movement of vibrations of the end wall.

TABLE 2

| Holding pressure P (gr) | Diameter of Moving Member (Steel Ball) 4.5 mm h' | 4.5 mm e | 4.0 mm h' | 4.0 mm e |
|---|---|---|---|---|
| 2 | 0.5 | 0.12 | 2 | 0.25 |
| 30 | 1 | 0.18 | 2 | 0.25 |
| 40 | 1 | 0.18 | 3 | 0.31 |
| 110 | 2.5 | 0.28 | 4.5 | 0.37 |
| 120 | 3 | 0.31 | 5 | 0.40 |
| 150 | 3 | 0.31 | 5 | 0.40 |
| 320 | 4.5 | 0.37 | 6 | 0.43 |
| 480 | 6.5 | 0.45 | 11 | 0.59 |
| 500 | 6.5 | 0.45 | 12 | 0.61 |
| 780 | 8 | 0.5 | 12 | 0.61 |

The results of an experiment conducted by the inventor will be described hereafter. Table 2 shows the height of rebound h' and the coefficient of rebound e ($\sqrt{h'/h}$) at the time when a moving member made up by a steel ball was allowed to drop vertically from the height h of 32 mm to the end wall of the moving member case formed by an acrylic resin, by varying the holding force of the moving member case. The table shows two kinds of ball as the moving member each having a diameter of 4.5 mm and 4.0 mm. Here, the holding force P is defined as a force with which the moving member case is pulled out from the toothbrush body.

As shown in Table 2, when the holding force P is 780 g, the coefficient of rebound becomes maximum at 0.61. It can be understood from the above that this value is lower than the allowable upper limit of the coefficient of rebound e.

Thus, if at least one end wall of the movement chamber is made separate from the toothbrush body and is installed in a non-fixed state, the coefficient of rebound can be held within an allowable range as compared with the case where the moving member case is installed on the toothbrush body in a fixed state, or where the entire movement chamber is formed integrally with the toothbrush body.

As a comparative example, Table 3 illustrates the height of rebound h' and the coefficient of rebound e in a case where the entire movement chamber is formed integrally with the toothbrush body and the falling height of the moving member was set to 29 mm. As can be understood from Table 3 as well, if the moving member case is fixed to the toothbrush body or formed integrally therewith, the coefficient of rebound e will disadvantageously exceed 0.65 which is the allowable upper limit.

TABLE 3

| | Diameter of Moving Member (Steel Ball) 4.5 mm | 4.0 mm |
|---|---|---|
| h' | 20 | 23 |
| e | 0.83 | 0.89 |

Table 4 shows the height of rebound h' (mm) and the coefficient of rebound e at the time when the moving member case (inside diameter: 4.8 mm) formed of an acrylic resin is held by hand in the air and is then allowed to fall vertically from a 31.5 mm height to the bottom of this moving member case, by varying the thickness t (mm) of the bottom of the moving member case, i.e., the end wall.

It can be seen from Table 4 that the thickness of the moving member case or at least the thickness t of the end wall is preferably 37 mm or less by taking into consideration the aforementioned allowable upper limit of the coefficient of rebound, 0.65. Incidentally, if the end wall is formed of a material having a greater mass, the thickness t thereof needs to be made thinner. For instance, in the case of iron, if the thickness if 7.5 mm, the coefficient of rebound becomes 0.65.

TABLE 4

| t | 1 | 10 | 19 | 28 |
|---|---|---|---|---|
| h' | 3 | 5.5 | 8 | 11.5 |
| e | 0.309 | 0.418 | 0.504 | 0.604 |
| t | 37 | 46 | 55 | 70 |
| h' | 13.5 | 14.5 | 15 | 15.5 |
| e | 0.655 | 0.678 | 0.690 | 0.701 |

Figure 19:
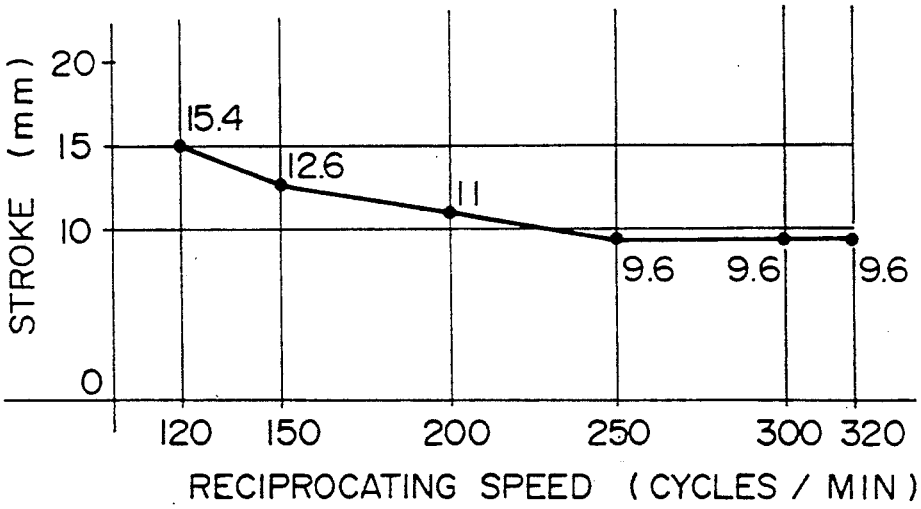
FIG. 19 is a graph illustrating the relationships between the reciprocating speed and stroke as another experimental example of the present invention.

FIG. 19 shows a graph where the reciprocating speed and the stroke were changed by using the toothbrush for controlling the brushing stroke in accordance with the above-described embodiment. Specifically, in FIG. 19, boundary points of the presence or absence of hitting of the moving member against the end walls of the moving member case are plotted, and a curve connecting these points is shown.

In the light of the aforementioned upper limit of 15±3 mm for the short stroke brushing, FIG. 19 shows that a substantially ideal stroke can be attained when the reciprocating speed is in the range of 120 to 320 cycles/min. In this experiment, a steel ball with a diameter of 4 mm was used as the moving member, the thickness of the moving member case was set to 1 mm, the inside diameter thereof was set to 4.4 mm, the movable distance of the moving member inside the moving member case was set to 24 mm, and the clearance between the moving member case and the toothbrush body in the longitudinal direction thereof was set to 0.5 mm.

In the foregoing embodiment and description, although the moving member was formed into a spherical shape, the present invention should not be restricted to said configuration. It goes without saying that this moving member may be formed into a cylindrical shape or other configuration insofar as the coefficient of friction between the moving member and the inner surface of the movement chamber is not large and the phenomenon of adsorption due to static electricity does not occur noticeably between the moving member and the end wall of the movement chamber.

A description will now be given of still another aspect of the present invention.

According to a further study made by the present inventor, it was found that, if the mass of the toothbrush body is decreased, the coefficient of rebound declines, and the sound pressure level at the time of hitting of the moving member is decreased, and that, if the mass of the moving member is decreased, the sound pressure level during hitting also drops. On the other hand, the so-called masking phenomenon occurs during brushing, making it difficult for a person to distinguish the hitting sound of the moving member since the sliding sound of the bristles against the teeth surfaces is transmitted to the user's ears and constitutes an interfering sound. Accordingly, a minimum audible sound pressure level of this hitting sound increases during brushing. The minimum audible sound pressure level in this context means a sound pressure level which can be heard with a considerable attention, and it should be noted that the value of the minimum audible sound pressure level would vary depending on the situation and condition where the sound is heard. Hence, it became clear that, in order to provide an effective warning sound during the long stroke brushing, a problem exists that the sound pressure level must be made higher by the so-called masking amount than the minimum audible level at the time when brushing is not conducted.

Such being the case, if the mass of the toothbrush body is increased to raise the sound pressure level, there is the possibility of the coefficient of rebound of the moving member becoming greater than the aforementioned figure 0.65, presenting a problem that the operating efficiency of the toothbrush deteriorates with an increase in the mass. In addition, if the mass of the moving member is increased, there is the problem that the size of the handle portion becomes necessarily relatively large, so that the person who brushes teeth feels uneasy at his hand, to which an impact energy is transmitted at the time of hitting, thereby deteriorating the operating efficiency.

Ninth and tenth embodiments of the present invention, which will be described below, have been devised in the light of this aspect. These embodiments make it possible to maintain the coefficient of rebound of the moving member against the end wall of the movement chamber at a low level so as to maintain the function of the toothbrush for controlling the brushing stroke, and also makes it possible to set the sound pressure level of the hitting sound during brushing to a level greater than the minimum audible level which is higher at least by the masking amount, thereby allowing a warning sound to be readily heard during the long stroke brushing.

To this end, the ninth and tenth embodiments are so arranged that the hitting portion constituting at least one end of the movement chamber is installed on the toothbrush body separately from the toothbrush body with a predetermined pressure, whereby the sound pressure level of the hitting sound can be maintained to a level higher than the minimum audible level.

As a result of making a strenuous study concerning means for increasing the sound pressure level during hitting of the moving member without increasing the mass of the toothbrush body and/or the moving member, the present inventor found that the sound pressure level is influenced by the pressure with which the hitting portion is installed on the toothbrush body. By setting the holding pressure depending on the materials of the toothbrush body, the moving member case, the end walls, etc. used, the sound pressure level of the hitting sound can be set to a minimum audible level or above even when the interfering noise of sliding between the teeth and the brush exists. Thus, the sound pressure level of the hitting sound can be set to a sufficiently high level and can be made clearly distinguishable.

Generally, the intensity of sound waves and, hence, the sound pressure level is a function of the frequency of sound, and the frequency of sound is a function of the tension of a sound-generating body. If the hitting portion is formed by the end wall of the moving member case, which will be described later, and if this moving member case is held with a certain holding pressure, deflection occurs in the moving member case and tension is generated as the result of this deflection. Consequently, it is possible to estimate a theoretical endorsement that the greater the holding pressure, the greater the sound pressure level becomes.

FIGS. 21 to 27 illustrate the ninth embodiment of the present invention. Those components or parts that are similar to those shown in FIG. 14 to 17 are denoted by the same reference numerals, and a description thereof will be omitted.

Figure 23:
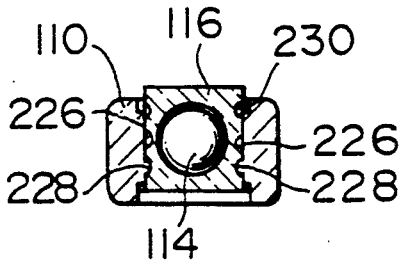
FIG. 23 is a cross-sectional view taken along the line XXIII—XXIII of FIG. 22.
Figure 24:
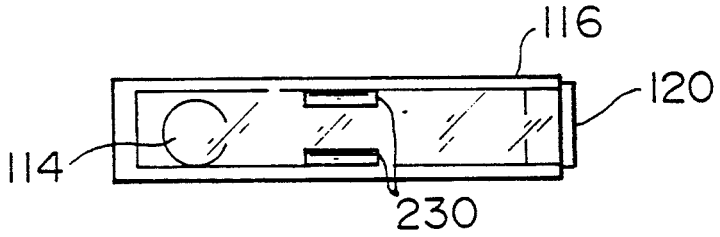
FIG. 24 is an enlarged front elevational view of a moving member case in the ninth embodiment.
Figure 25:
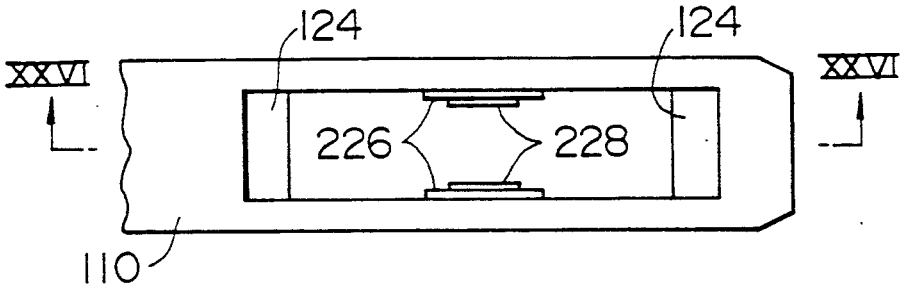
FIG. 25 is a top plan view illustrating a cavity in a toothbrush body in the ninth embodiment.
Figure 26:
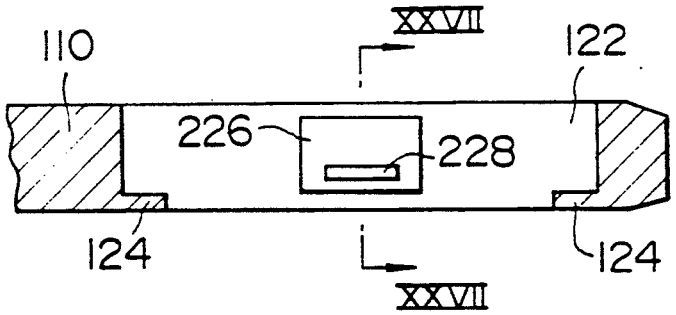
FIG. 26 is a cross-sectional view taken along the line XXVI—XXVI of FIG. 25.
Figure 27:
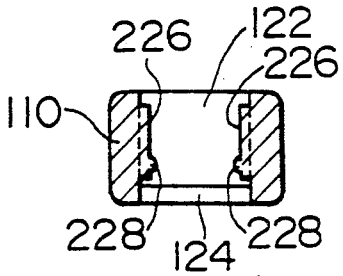
FIG. 27 is a cross-sectional view taken along the line XXVII—XXVII of FIG. 26.

As shown in detail in FIGS. 25 to 27, projecting surface portions 226 are respectively formed integrally on opposite inner walls in the cavity 122 of the toothbrush body 110 so that the moving member case 116 can be installed in the cavity 122 with a predetermined holding pressure P. The projecting surface portions 226 respectively project inwardly of the cavity 122, and the interval therebetween is made smaller than that between the outer wall surfaces of the moving member case 166. Consequently, when the moving member case 16 is pressed into the opening 122, a predetermined pressure P is imparted to the moving member case 116. In this embodiment, as shown in FIG. 26, each of the projecting surface portions 226 is formed into a rectangular shape, as viewed from the front, and is disposed substantially in the axially central portion of the cavity 122. However, the arrangement should not be restricted to the same, and various configurations may be adapted alternatively. Furthermore, a retaining portion 228 which projects further inwardly of the projecting surface portion 226 is formed integrally on a part of the projecting surface portion 226 in order to positively prevent the moving member case 16 from coming off the cavity 122. Meanwhile, as shown in FIG. 24, a recess 230 is formed integrally at a position of the side wall of the moving member case 116 that corresponds to the retaining portion 228. As shown in FIGS. 23 and 24, a pair of recesses 230 are provided on each side surface of the movement member case 116 in such a manner as to be disposed at upper and lower positions thereof. Consequently, even if the moving member case 116 is inserted upside down, the retaining portions 228 of the projecting surface portions 226 fit into the recesses 230 with a certain degree of tightness, thereby making it possible for the moving member case 116 to be fitted positively in the cavity 12.

Figure 28:
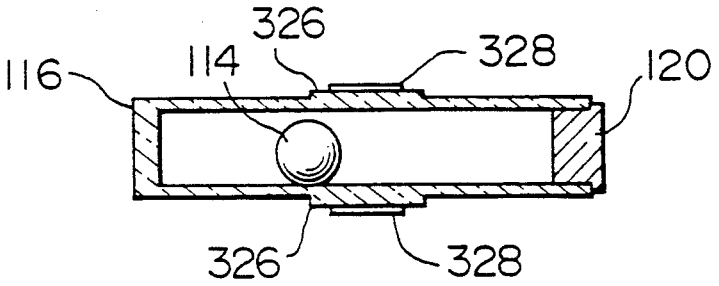
FIG. 28 is a cross-sectional view of a moving member case illustrating a tenth embodiment of the present invention.
Figure 29:
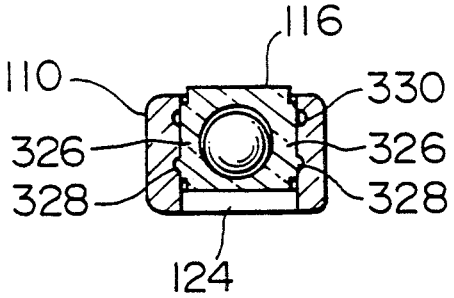
FIG. 29 is a cross-sectional view of the tenth embodiment taken at the same position as FIG. 23.

FIGS. 28 and 29 illustrate the tenth embodiment of the present invention. This tenth embodiment differs from the ninth embodiment in that projecting surface portions 326 respectively projecting outwardly are formed integrally on the opposite side walls of the moving member case 116, and that the distance between outer wall surfaces of the projecting surface portions 326 is made greater than that between inner wall surfaces in the cavity 122. In this tenth embodiment, the retaining portions 328 are also respectively formed integrally on the projecting surface portions 326, while recesses 330 for engagement with the retaining portions 328 are formed in the cavity 122.

In the above described embodiment, the moving member case 116 can be fitted in the toothbrush body 110 with the holding pressure P. Table 5 shows the results of the experiment which reveals that the sound pressure level SPL of the hitting sound changes at the time when the moving member hits against the end wall of the moving member case as the holding pressure P is changed.

TABLE 5

| Allowance for Tightening (mm) | 0.2 | 0.4 | 0.6 | 0.8 |
|---|---|---|---|---|
| Pressure (kg) | 2.2 | 4.2 | 5.6 | 7.2 |
| SPL (dB) | 71.0 | 71.6 | 71.9 | 72.9 |
| Allowance for Tightening (mm) | 0 | 0.05 | 0.1 | 0.15 |
| Pressure (kg) | 0 | 0.3 | 0.75 | 1.2 |
| SPL (dB) | 64.0 | 64.0 | 66.8 | 67.4 |

In this experiment, the toothbrush body was formed by ABS resin, the moving member case was formed by acrylic resin, and a 4.8 mm-diameter steel ball was used as the moving member. The inside diameter of the movement chamber was set to 5 mm, the thickness of each of the end walls of the moving member case was set to 1 mm, and the overall length of the moving member case was set to 32 mm, and the external configuration thereof was made into a 7 mm square. The dimensions of each of the projecting surface portions formed in the cavity of the toothbrush body were set to $8\times5$ mm. Thus a toothbrush weighing 13 g as a whole was prepared. This toothbrush was moved back and forth at a reciprocating distance, i.e., stroke, of approximately 15 mm and a speed of about 250 cycles/min. A probe for detecting the sound pressure level was installed at a position 40 mm away from the toothbrush. The allowance for tightening referred to in Table 5 is a difference in the distance between the inner wall surfaces in the cavity in cases where the moving member case was inserted in the cavity and where it was not. The pressure P is the result of measurement of a pressure required in imparting the allowance for tightening, while the pressure level SPL is given in terms of A characteristics of an all-pass audible sound compensating circuit of an octave band filter, using the Kanomax Sound-Level Meter Model 4030.

As is apparent from Table 5, it will be appreciated that the greater the allowance for tightening and, hence, the holding pressure P, the more the sound pressure level SPL increases.

In the foregoing embodiment, the movement chamber for the moving member was formed by a separate moving member case. However, the present invention is not restricted to this arrangement, and it suffices if a hitting portion constituting at least one end of the movement chamber is formed separately from the toothbrush body and is installed on the toothbrush body with a predetermined pressure.

Figure 30:
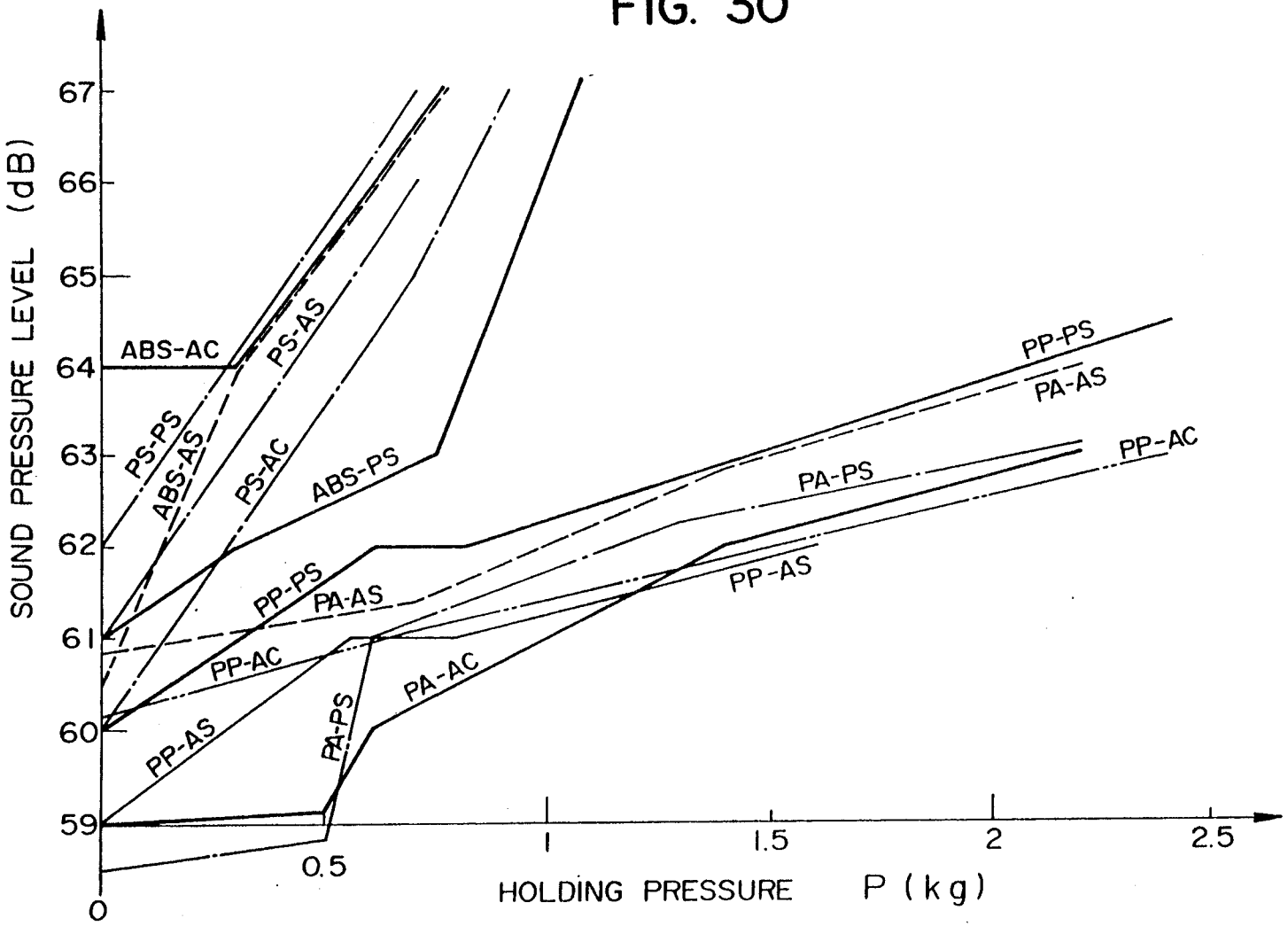
FIG. 30 is a graph illustrating the relationships between a holding pressure and a sound pressure level as still another experimental example of the presnet invention.

Through a further experiment conducted in a manner similar to the one described above, the relationships between the holding pressure and the sound pressure level were confirmed by varying the materials of the toothbrush body and the moving member case. The results are shown in FIG. 30. In this graph, reference character ABS denotes ABS resin; AC, acrylic resin; AS, AS resin; PS, polystyrene; PA, nylon; and PP, polypropylene. In addition, reference character ABS-AC means that ABS resin was used for the toothbrush body, and AS resin for the moving member case. FIG. 30 reveals that if the holding pressure is increased at least in the range of 0–2.5 kg., the sound pressure level also increases. It should be noted that if ABS resin or polystyrene is used for the toothbrush body, the rate of rise in the sound pressure level with a rise in the holding pressure increases more as compared with a case where nylon or polypropylene is used, so that the use of this type of resin for the toothbrush body may be suitable in the present invention.

Another experiment was conducted as to the ideal minimum audible sound pressure level of the hitting sound of the moving member where the masking phenomenon exists during brushing. As a result of the experiment, it was found that, when the sound pressure level of the hitting sound was about 60 dB, the user was able to hear the hitting sound with considerable attention, and that, when the sound pressure level was about 65 dB, it was able to hear the hitting sound very easily. Accordingly, it can be understood that, by referring to FIG. 30, if, for instance, ABS resin is used for the toothbrush body and acrylic resin for the moving member case while the holding pressure is set to about 0.5 kg, it is possible to obtain 65 l dB at which it is possible to hear the hitting sound very easily.

I claim:

1. A toothbrush for controlling brushing-stroke, comprising: an elongate handle portion having therein an elongate chamber which extends lengthwise of said handle portion and which has at an end thereof an end surface; a brush portion which is provided at one end of said handle portion and is studded with bristles; and a member disposed within said chamber for reciprocal movement therein in response to reciprocal movement of said toothbrush; wherein a coefficient of friction between said member and said handle portion is less than 4.666 to cause said member to hit said end surface of sad chamber on substantially every brushing stroke which is longer than a predetermined distance; wherein a coefficent of rebound of said member from said end surface is less than 0.65 to prevent repeated hitting of said end surface by said member during successive brushing strokes which are less than said predetermined distance; and wherein said member hits said end surface of said chamber when the brushing-stroke of said reciprocal movement of said toothbrush is longer than said predetermined distance and makes an audible warming sound.

2. A toothbrush according to claim 1, wherein said member is a movable weight.

3. A toothbrush according to claim 1, wherein when a speed of said reciprocal movement of said toothbrush is in the range of 120 to 320 cycles per minute, said predetermined distance is $15\pm3$ mm.

4. A toothbrush according to claim 11, wherein said handle portion includes a first part having said brush portion supported thereon, sand a second part which is removably supported on said first part and which is a casing having therein said chamber.

5. A toothbrush according to claim 11, wherein said brush portion is removably coupled with said handle portion.

6. A toothbrush according to claim 1, wherein said member is a ball.

7. A toothbrush according to claim 1, wherein said member is a cylindrical element.

8. A toothbrush according to claim 1, wherein said member is an oscillating element.

9. A toothbrush according to claim 1, wherein said warning sound is a rattling sound caused by said member alternately hitting the end surfaces at opposite ends of said chamber.

10. A toothbrush according to claim 1, wherein a distance of movement of said member within said chamber is less than 32 mm.

11. A toothbrush according to claim 1, wherein a sound pressure level of said warning sound is at least 60 dB.

12. A toothbrush according to claim 1, wherein said handle portion includes a handle part and a further member separate therefrom, and wherein each end surface at each end of said chamber is provided on said further member.

13. A toothbrush according to claim 1, wherein said handle portion includes at least one transparent wall portion defining said chamber, whereby the movement of said member is visible.

14. A toothbrush for controlling brushing-stroke comprising: a toothbrush body which includes a head portion studded with bristles, and an elongate handle portion having therein an elongate chamber extending lengthwise thereof, said handle portion including a first part and including a second part which is a member separate from the supported on said first part, said second part having thereon an end surface for one end of said chamber; and a member disposed within said chamber for reciprocal movement therein in response to reciprocal movement of said toothbrush; wherein a coefficient of friction between said member and said handle portion is less than 0.4666 to cause said member to hit said end surface of said chamber on substantially every brushing stroke which is longer than a predetermined distance; wherein a coefficient of rebound of said member from said end surface is less than 0.65 to prevent repeated hitting of said end surface by said member during successive brushing strokes which are less than said predetermined distance; and wherein said member hits said end surface of said chamber when the brushing-stroke of said reciprocal movement of said toothbrush is longer than said predetermined distance and makes an audible warning sound.

15. A toothbrush according to claim 14, wherein said member is a movable weight.

16. A toothbrush according to claim 14, wherein said second part is supported on said first part so as to be capable of microscopical movement relative to said first part lengthwise of said handle portion.

17. A toothbrush according to claim 14, wherein said second part is a casing which has said chamber therein.

18. A toothbrush according to claim 17, wherein said first part has therein a cavity, and said casing is disposed in said cavity.

19. A toothbrush according to claim 18, wherein said casing is capable of at least microscopical movement relative to said first part.

20. A toothbrush according to claim 14, wherein said movable member is a ball.

21. A toothbrush according to claim 14, wherein said handle portion includes at least one transparent wall portion defining said chamber, whereby the movement of said movable member is visible.

22. A toothbrush for controlling brushing-stroke comprising: a toothbrush body which includes a head portion studded with bristles and an elongate handle portion having therein an elongate chamber extending lengthwise thereof, said handle portion including separate first and second parts, said second part having thereon an end surface for one end of said chamber and being removably retained on said first part by a predetermined holding pressure; and a member disposed within said chamber for reciprocal movement therein in response to reciprocal movement of said toothbrush; wherein a coefficient of friction between said member and said handle portion is less than 0.466 to cause said member to hit said end surface of said chamber on substantially every brushing stroke which is longer than a predetermined distance; wherein a coefficient of rebound of said member from said end surface is less than 0.65 to prevent repeated hitting of said end surface by said member during successive brushing strokes which are less than said predetermined distance; and wherein said member hits said end surface of said chamber when the brushing-stroke of said reciprocal movement of said toothbrush is longer than said predetermined distance to make an audible rattling sound, said rattling sound having a sound pressure level which is dependent on said predetermined holding pressure and is more than a minimum audible sound pressure level.

23. A toothbrush according to claim 23, wherein said second part is a casing which has said chamber therein, and wherein said first part has a cavity within which said casing is disposed.

24. A toothbrush according to claim 23, including a pressure applying arrangement which applies said predetermined holding pressure onto said casing.

25. A toothbrush according to claim 24, wherein said pressure applying arrangement includes a projection formed on one of an outer surface of said casing and an inner surface of said cavity.

26. A toothbrush for controlling brushing-stroke, comprising: a brush portion studded with bristles; an elongate handle portion extending from said brush portion and having therein a chamber which has end surfaces at opposite ends thereof; and a member disposed within said chamber for reciprocal movement therein in response to reciprocal movement of said toothbrush; wherein a coefficient of friction between said member and said handle is less than 0.466 to cause said member to hit one of said end surfaces of said chamber on substantially every brushing stroke which is longer than a predetermined distance of 15±3 mm; wherein a coefficient of rebound of said member from each said end surface is less than 0.65 to prevent repeated hitting of said end surfaces by said member during successive brushing strokes which are less than said predetermined distance; and wherein said member alternatively hits said end surfaces of said chamber to make an audible warning sound when a brushing-stroke of said reciprocal movement of said toothbrush is longer than 15±3 mm and when a speed of said reciprocal movement is in the range of 120 to 320 cycles/min.

27. A toothbrush according to claim 25, wherein said handle portion includes at least one transparent wall portion defining said chamber, whereby the movement of said member is visible.

28. A toothbrush for controlling brushing-stroke, comprising an elongate handle having therein a cavity which extends lengthwise of said handle portion and which opens through a side surface of said handle portion, said cavity having in a central region thereof on opposite sides thereof respective projecting portions which project toward each other and have respective surfaces thereon which face each other, each said projecting portion having a retaining portion which projects inwardly into said cavity from said surface thereon toward the retaining portion on the other of said projecting portions; a brush portion which is supported on said handle portion at one end thereof and is studded with bristles; an elongate casing having therein an elongate chamber and having two recesses on opposite sides thereof, said casing being removably disposed in said cavity with said chamber extending lengthwise of said handle portion and said retaining portions each being disposed in a respective one of said recesses, and said surfaces on said projecting portions engaging opposite sides of said casing and applying thereto a predetermined holding pressure; and a member disposed within said chamber for reciprocal movement lengthwise thereof in response to reciprocal lengthwise movement of said handle portion of said toothbrush; wherein a coefficient of friction between said member and said handle portion is less than 0.466 to cause said member to hit an end surface of said chamber on substantially every brushing stroke which is longer than a predetermined distance; wherein a coefficient of rebound of said member from said end surface is less than 0.65 to prevent repeated hitting of said end surface by said member during successive brushing strokes which are less than said predetermined distance; and wherein said member hits said end surface of said chamber when the brushing stroke of said reciprocal movement of said toothbrush is longer than said predetermined distance and makes an audible warning sound.

29. A toothbrush according to claim 28, wherein said casing includes an elongate first part made of a transparent material and having said chamber extending therein from one end thereof, and includes a second part having a portion disposed in an end of said chamber at said one end of said first part.

30. A toothbrush according to claim 29, wherein said cavity has an approximately square cross section, wherein said casing has an approximately square cross section, wherein said surfaces on said projecting portions are approximately rectangular, wherein said chamber in said casing is substantially cylindrical, wherein said member is a ball, and wherein said first and second parts of said casing are made of respective materials having different hardnesses so that sounds of different magnitude, pitch and tone result when said ball hits opposite end surfaces of said chamber.

31. A toothbrush according to claim 30, wherein when a speed of said reciprocal movement of said toothbrush is in the range of 120 to 320 cycles per minute, said predetermined distance is 15±3 mm, wherein a sound pressure level of said warning sound is at least 60 dB, wherein the length of said casing is less than a length of said cavity and said casing is capable of reciprocal movement relative to said handle portion in a direction lengthwise of said handle portion by a microscopic amount substantially less than the lengths of said cavity and casing, and wherein said cavity extends completely transversely through said handle portion and said handle portion has two flanges projecting toward each other into said cavity lengthwise of said handle portion from opposite ends of said cavity, said flanges limiting an insertion movement of said casing into said cavity in a direction transversely of said handle portion.

* * * * *

UNITED STATES PATENT AND TRADEMARK OFFICE

CERTIFICATE OF CORRECTION

PATENT NO. : 5 134 743

DATED : August 4, 1992

INVENTOR(S) : Hiroshi HUKUBA

It is certified that error appears in the above-identified patent and that said Letters Patent is hereby corrected as shown below:

Column 18, line 42; replace "4.666" with ---0.466---.
line 43; replace "sad" with ---said---.
line 52; replace "warming" with ---warning---.
line 61; replace "Claim 11" with ---Claim 1---.
line 63; replace "sand" with ---and---.
line 66; replace "Claim 11" with ---Claim 1---.
Column 19, line 33; replace "from the supported" with ---from and supported---.
line 39; replace "0.4666" with ---0.466---.
Column 20, line 30; replace "Claim 23" with ---Claim 22---.
line 57; replace "alternatively" with ---alternatingly---.
line 63; replace "Claim 25" with ---Claim 26---.
Column 22, line 5; replace "therein" with ---thereinto---.

Signed and Sealed this

Nineteenth Day of October, 1993

*Attest:*

*Attesting Officer*

BRUCE LEHMAN

*Commissioner of Patents and Trademarks*